US007363724B2

(12) United States Patent
Krogt

(10) Patent No.: US 7,363,724 B2
(45) Date of Patent: Apr. 29, 2008

(54) DRIER

(75) Inventor: Pepijn van der Krogt, Santiago (CL)

(73) Assignee: Princess Worldwide Ltd., Hong Kong (CN)

( * ) Notice: Subject to any disclaimer, the term of this patent is extended or adjusted under 35 U.S.C. 154(b) by 248 days.

(21) Appl. No.: 10/492,799

(22) PCT Filed: Oct. 15, 2002

(86) PCT No.: PCT/CN02/00726

§ 371 (c)(1),
(2), (4) Date: Sep. 17, 2004

(87) PCT Pub. No.: WO03/032768

PCT Pub. Date: Apr. 24, 2003

(65) Prior Publication Data

US 2005/0016558 A1 Jan. 27, 2005

(30) Foreign Application Priority Data

Oct. 15, 2001 (CN) ..... 01 2 67645 U

(51) Int. Cl.
*A45D 20/00* (2006.01)

(52) U.S. Cl. ..... 34/96; 34/97

(58) Field of Classification Search ..... 34/96, 34/97, 98, 99

See application file for complete search history.

(56) References Cited

U.S. PATENT DOCUMENTS

| | | | | | |
|---|---|---|---|---|---|
| 1,639,753 | A | * | 8/1927 | Shelton | 362/282 |
| 3,384,977 | A | * | 5/1968 | Rosenberg | 34/90 |
| 4,278,223 | A | | 7/1981 | Fauteux | |
| 4,538,362 | A | * | 9/1985 | Andis | 34/97 |
| 4,802,287 | A | * | 2/1989 | Chen | 34/91 |
| 5,235,759 | A | * | 8/1993 | Rizzuto, Jr. | 34/97 |
| 5,832,624 | A | * | 11/1998 | Narrin | 34/97 |
| 5,937,537 | A | * | 8/1999 | Miller | 34/97 |

FOREIGN PATENT DOCUMENTS

| | | |
|---|---|---|
| CN | 2123212 U | 12/1992 |
| CN | 2193671 Y | 5/1995 |
| CN | 2358743 Y | 1/2000 |
| EP | 0 318 133 A1 | 5/1989 |
| JP | 10-337213 | 12/1998 |
| JP | 11-123107 | 5/1999 |

* cited by examiner

*Primary Examiner*—Kenneth Rinehart
(74) *Attorney, Agent, or Firm*—Banner & Witcoff, Ltd.

(57) ABSTRACT

A drier comprising a drier body, wherein includes a base which is detachable from the drier body, and further includes a jointing part and a holder part. Said base is provided with an opening for inserting the drier body which is connected to the base via the opening. Said base is mounted to the holder part by the jointing part. The drier can be used both by hands, and also can be placed steadily at desired position or the surface of an object when used. Thus it can overcome the shortcoming of limited working position or the problem which the user's two hands can't be available when used.

4 Claims, 6 Drawing Sheets

DRIER

This application claims priority from PCT Application No. PCT/CN02/00726, filed Oct. 15, 2002 (incorporated by reference herein).

FIELD OF THE INVENTION

The invention relates to a hair drying device, and more particularly to a drier.

DESCRIPTION OF THE RELATED ART

At present, the drier is mainly designed to let a user hold the drier body in his hand directly. Thus operating this kind of device may lead to the following problems: as the drier must be used by hands, the user holding the drier for a long time is inclined to get tired easily; the user can't do other things with two hands simultaneously as one hand is always occupied, for instance do hair; the user can't deal with other matters while he is using the drier.

In view of the above problems, Chinese utility model patent No. 94202923.2 discloses a drier structure which can expand and contract and can be bent. The drier consists of the following simply and easy components like a drier body, a smooth handle, an extended block and so on. Although such a drier could be used according to personal requirement, such as be bent optionally at 85° or 45° to dry hair, or be placed on a table to blow hair with the air outlet opposite to the hair through adjusting the length of the extended block, the structure thereof is still relatively complicated. Furthermore, the drier can't rest on a tabletop steadily as the smooth handle and the extended block are still in the shape of the traditional handle.

SUMMARY OF THE INVENTION

The present invention is designed to provide a drier which could be used by hands or placed on a holder apparatus steadily.

Another object of the invention is to provide a drier which could be used by fixing it on a plane without holding it with hands.

In order to accomplish the above objects, the technical solution of the invention is to provide a drier comprising a drier body, which is characterized by the fact that further comprises: a base which is detachable from said drier body; said base being provided with an opening for inserting the drier body's tail acting as the air inlet; said tail of said driver body being inserted into said opening of said base; said drier body having a traditional structure equal to that of the current drier. Air intakes may be provided on said base.

Said drier is characterized by the fact that air intakes may be provided on said base.

Said drier is characterized by the fact that support bulges may be arranged at the bottom of said base.

Said drier is characterized by the fact that grooves may be formed on the sidewalls which make up of the opening of said base so as to hold the power wire of said drier body.

Yet another object of the invention is to provide a drier which can be placed on a desired place or surface of an object to work. Using such a drier will not only free the user's two hands but also make the working position unlimited and make the drier rest steadily.

In order to accomplish the above object better, the technical solution of the invention is to provide a drier comprising a drier body, said drier farther comprises a base which is detachable from said drier body; a jointing part and a holder part; said base being provided with an opening for inserting said drier body; said drier body being connected to said base through said opening; said base being mounted to said holder part by said jointing part.

Said base may be in the shape of a bowl; the sidewalls of said base may be provided with grooves as well as air intakes; said base being nested out the outerwall of the tail acting as the air inlet of the drier body; the bottom of said base covers the undersurface of tail of the drier body. Said jointing part may be a connecting bore located on the bottom of said base, and said holder part is provided with a corresponding connecting, thus the bottom of said base could be connected to the connecting of the holder part via the connecting bore.

Said drier is characterized by the fact that said connecting bore may be a screw, a socket or a hole; said holder part may be a stand; said connecting may be the top part of said stand; said top part may be provided with the screw threads matched with said screw, or a plug matched with said socket, or a chuck matched with said hole. Thereby said base may be screwed, socketed, or chucked onto the stand.

In order to accomplish the above object better, another technical solution of the invention is to provide a drier comprising a drier body, which further comprises: a base which is detachable from said drier body: a jointing part and a holder part; said base being provided with an opening for inserting said drier body; said drier body being connected to said base through said opening; said base being mounted to said holder part by said jointing part. Said base may be a bracket, and said jointing part may be a well-known vacuum adsorption connected apparatus which is adsorbed to said holder part by cupulas on the reverse thereof. Said holder part may be a wall, mirror or tabletop and so on which surface is smooth. The front of the connected apparatus is connected with the reverse of the bracket. The front of said connected apparatus is provided with sunk pits in which bulges with chucks are formed, and said bulges extend outward from the front of the connected apparatus. Said bracket includes a vaulted hood provided with sleeves extending reverseward therefrom, and said sleeves and said bulges are nested correspondingly in the form of the ends of said bulges being not exceeding the front of said hood after nesting. The bracket further includes two side limit panels, a piece of prolonged backboard and a bottom splint; said two side limit panels extending outward are fixed on the front of the hood and are located on the both sides of said inserted drier body; said prolonged backboard extending downwards from the front of said hood is located between said two side limit panels; said splint is fixed on the front of said prolonged backboard extending outward and is located on the bottom of said inserted drier body.

Said drier is characterized by the fact that said base may be a sleeve which is nested onto the sidewalls of said drier body; said jointing part belongs to a certain part surface of the outerwall of said sleeve which is in line with a part surface of said holder part and is connected with the holder part. Said holder part is a handle whose surface connecting with the base is its top surface. The top surface of the handle is pasted fixedly with the part surface acting as the jointing part of the base in the shape of a sleeve.

In order to accomplish the object better, the third technical solution of the invention is to provide a drier comprising a drier body, which further comprises: a base which is detachable from said drier body; a jointing part and a holder part; said base being provided with an opening for inserting said drier body; said drier body being connected to said base through said opening; said base being mounted to said holder part by said jointing part. Said base may be a sleeve which is nested onto the sidewalls of said drier body; said jointing part belongs to a certain part surface of the outerwall of said sleeve which is in line with a part surface of said holder part and is connected with the holder part. Said holder part is a handle whose surface connecting with the base is its top surface. The top surface of the handle is pasted fixedly with the part surface acting as the jointing part of the base in the shape of a sleeve.

Said drier is characterized by the fact that said extended head may be an air outflow opening, the tail of which is nested tightly outside the head of said drier body. And the head of the air outflow opening is in the shape of a flat mouth.

Said drier is characterized by the fact that said extended head may be an air outflow passage run-through along its axis, the tail of which is nested tightly outside the head of said drier body. The middle of the air outflow passage swells out like a sphere. The head and tail of the air outflow passage form a certain angle with the middle thereof as the peak of the angle.

Said drier is characterized by the fact that said extended head may be a through air outflow head, the tail of which is nested tightly outside the head of said drier body. And the head thereof swells out along its radial like a semicircular cake. Some crossbars are arranged in the air outflow opening of the head of said air outflow end.

Said drier is characterized by the fact that said extended head may be a through air outflow head, the tail of which is nested tightly outside the bead of said drier body, and the head of which is a hollow hemispheroid. There are some ventilation holes and some outward tubes on the plane of the hollow hemispheroid. The tails of the tubes are connected with the hemispheroid, and the tops of the tubes are provided with ventilation holes.

Said drier is characterized by the fact that said extended head may be a through hose run-through along its axis, both the tail and the head of which are two sleeves respectively. The sleeve acting as the tail is nested tightly outside the head of said drier body. The sleeve acting as the head may be used by nesting it onto the tail of the other extended heads.

Said drier is characterized by the fact that the tail of said extended head may be in the shape of a sleeve and be nested tightly outside the head of said drier body; and the middle thereof is a through hose, and the head thereof is a cover which is connected with the through hose.

Said drier is characterized by the fact that said extended head may be divided into two parts. The first part is a ventilation tube with a closed head. There are some rows of comb teeth extending outward arranged along the longitudinal direction of the surface of the ventilation tube. There are some ventilation slots arranged on the wall of the ventilation tube between the every row of comb teeth. The inner wall of the tail of the ventilation tube is provided with grooves. The second part is a sleeve whose tail is nested tightly outside the head of said drier body. The diameter of a segment of front part of said sleeve is smaller than that of the tail of the ventilation tube, and the outer wall of front part of the sleeve is provided with projected chucks. The ventilation tube and the sleeve can be fastened together via the grooves and the chucks.

DESCRIPTION OF THE PREFERRED EMBODIMENTS

Figure 1:
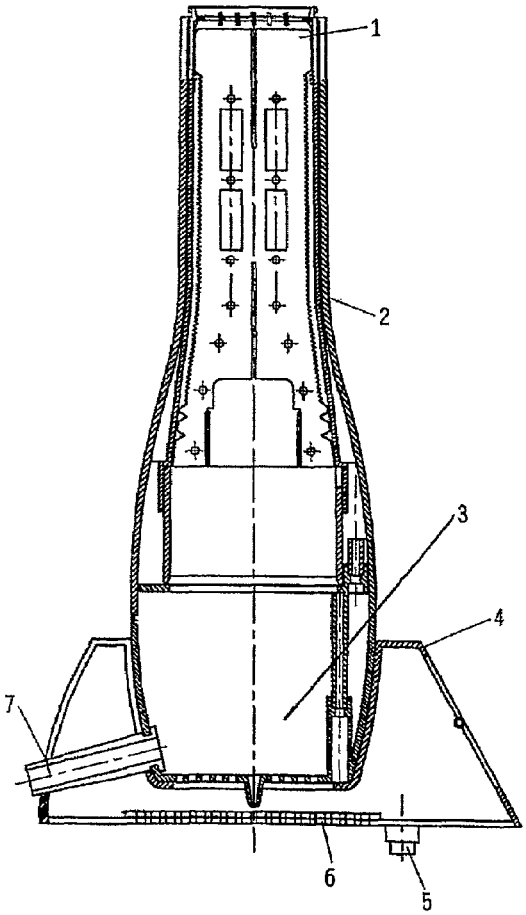
FIG. 1 is a schematic view showing the longitudinal section according to the first embodiment of the present invention.
Figure 2:
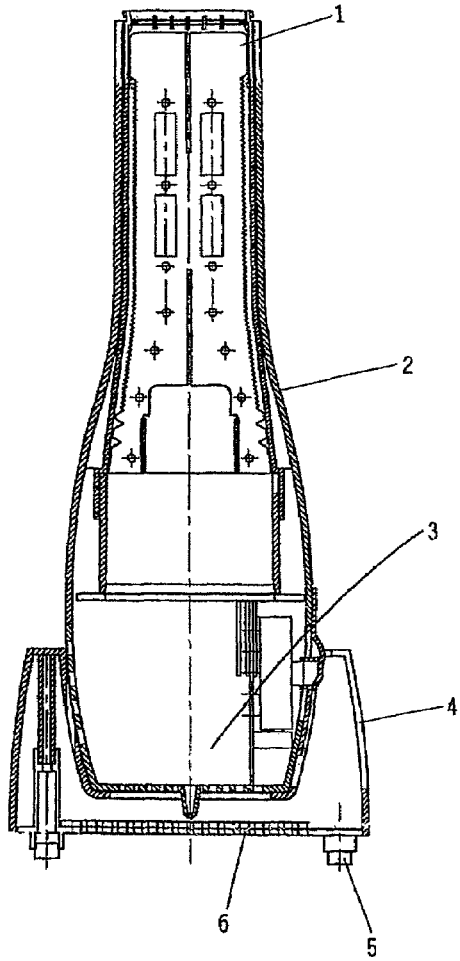
FIG. 2 is schematic view showing another longitudinal section which is perpendicular to the longitudinal section of FIG. 1.
Figure 3:
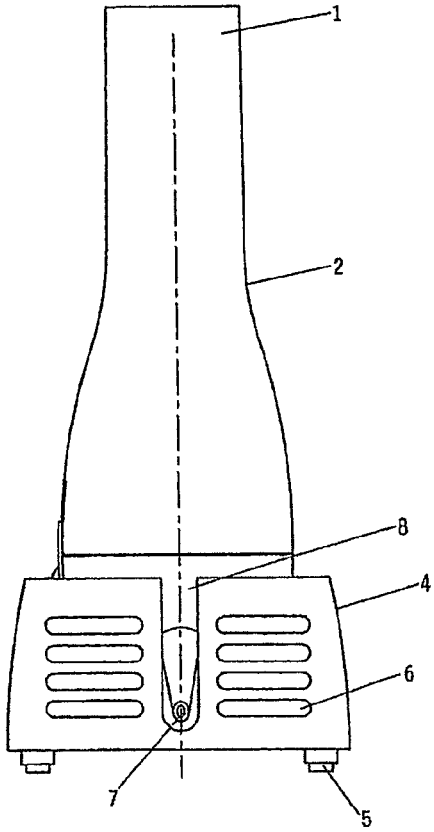
FIG. 3 is a schematic view showing the apparent structure according to the first embodiment of the present invention.
Figure 4:
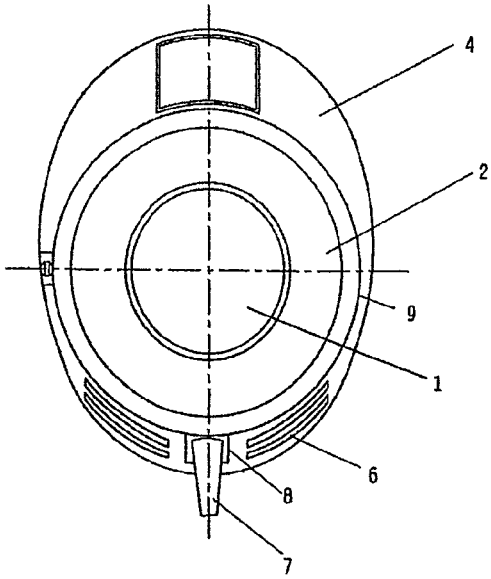
FIG. 4 is a plan view according to the first embodiment of the present invention.

The preferred embodiments of the present invention will be described in more detail with reference to the accompanying drawings.

Referring to FIGS. 1-4, the drier of the present invention comprises a drier body, and further comprises: a base 4 which is detachable from said drier body 2; said base 4 being provided with an opening 9 for inserting the tail 3 acting as the air inlet of the drier body 2; said tail 3 of said drier body 2 being inserted into said opening 9 of said base 4; said drier body 2 having a traditional structure equal to that of the current drier. Air intakes 6 may be provided on said base 4. Support bulges 5 may be arranged at the bottom of said base 4. Grooves 8 are formed on the sidewalls which make up of the opening 9 of said base 4 so as to hold the power wire 7 of said drier body 2. When the drier is used, the drier body 2 can rest firmly on the surface of a table with the base 4 and support bulges 5 by inserting the tail 3 of the drier body 2 into the opening 9 of the base 4, and drawing the power wire 7 connected with the tail 3 of the drier body 2 from the grooves 8 on the sidewalls of the base 4. To be sure, the bulges 5 may be changed into other underprops, such as idler wheels, and the surface of the table also may be changed into the plane of the other objects. Because the base 4 are provided with air intakes 6, the tail 3 of the drier body 2 can obtain a desired air, thereby the normal work of the drier can be guaranteed. Furthermore, as the sidewalls of the base 4 are provided with the groove 8, the disturbance of the power wire 7 of the drier body 2 are resolved, thus the tail 3 of the drier body 2 can be easily inserted into the opening 9 of the base 4.

In other embodiments, the drier of the present invention comprises, in addition a drier body 2 and a base 4, a holder part and a jointing part. Said drier body 2 is connected to the base 4, and the base 4 is connected to the holder part by the jointing part.

Figure 5:
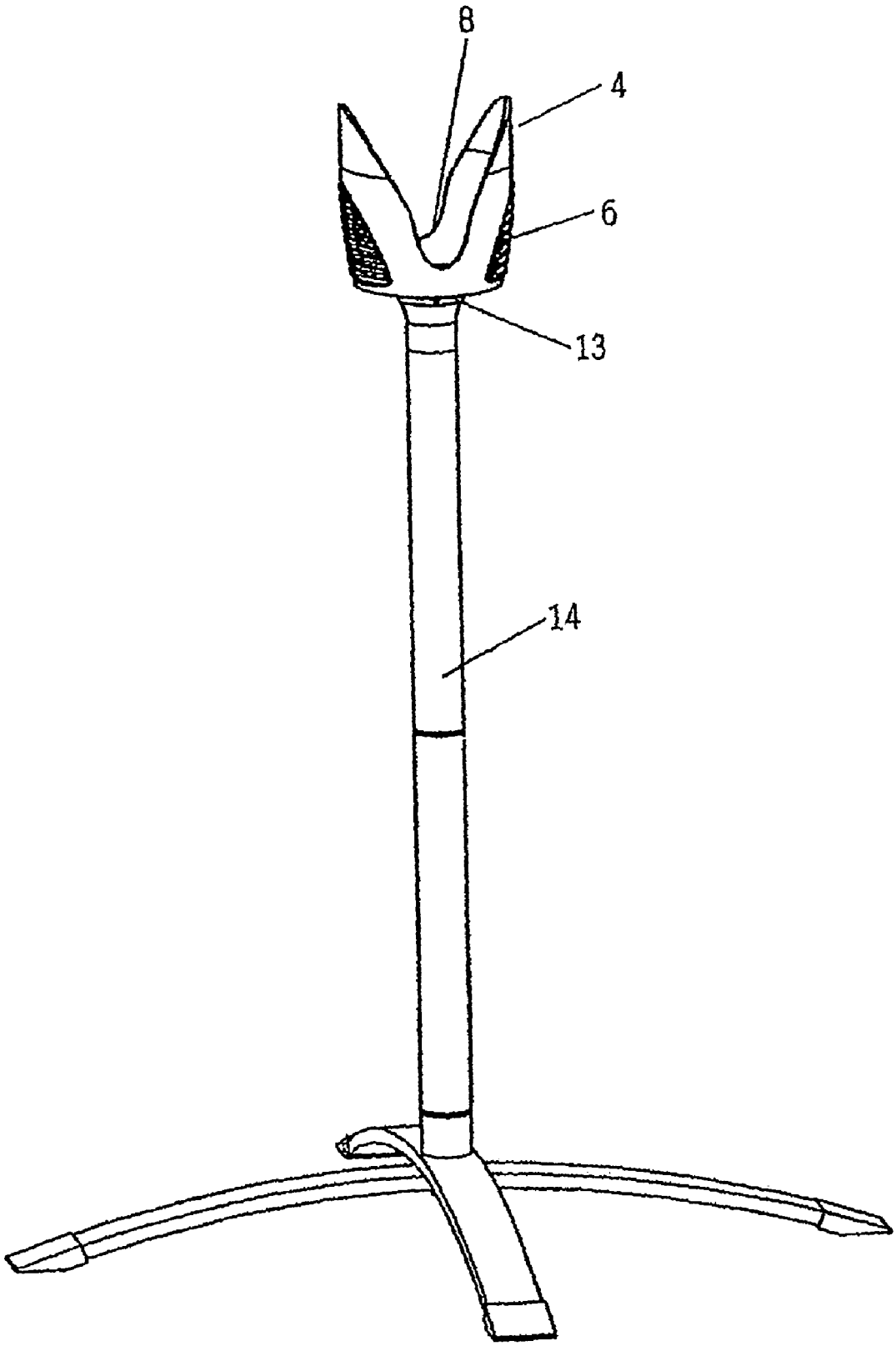
FIG. 5 is a schematic view showing the structure that the base is mounted on the stand according to the second embodiment of the present invention.

As shown in FIG. 5, said base 4 is in the shape of a bowl, and the sidewalls of the base 4 is provided with grooves 8 as well as air intakes 6. The base 4 is nested out the outerwall of the tail 3 acting as the air inlet of the drier body 2, and the bottom of the base 4 covers the undersurface of tail 3 of the drier body 2. The jointing part is a screw 13 on the bottom of the base 4. The holder part is a stand 14 on the top portion of which the screw thread matched with the screw 13 is formed. So the bottom of the base 4 is screwed onto the top end of the stand 14 via the screw 13.

It will be understood that the holder part also may be other well-known objects having the function of supporting, and the jointing part also may be a socket or a hole, and the connection with the supporting object may use other well-known ways, such as socketing, chucking and so on. When the user needs to operate the drier, he can place the stand on a desired position with a desired height, and then connect the base 4 to the top of the stand, and then insert the tail 3 of the drier body 2 into the base 4.

Figure 6:
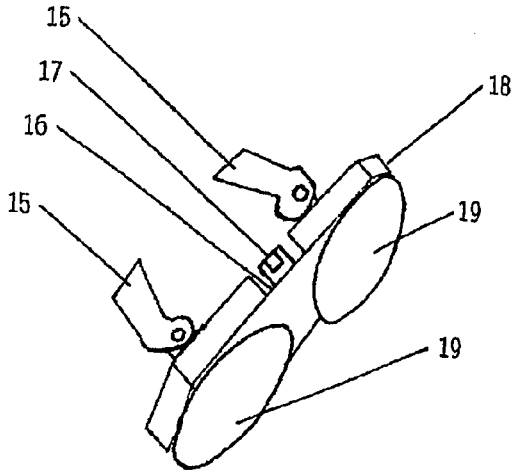
FIG. 6 is a schematic view showing the three-dimensional structure that the levers on the front of the adsorption connected apparatus of the base are unfastened according to the third embodiment of the present invention.
Figure 7:
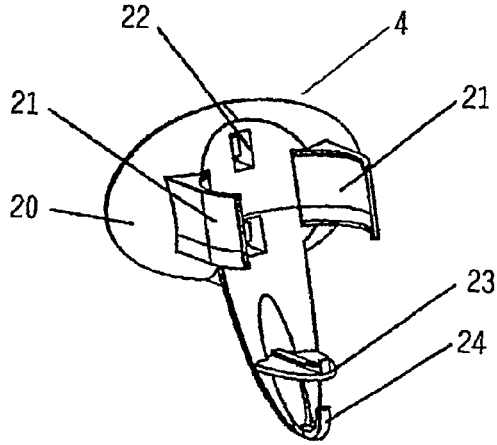
FIG. 7 is a schematic view of showing the structure of the base in the shape of a bracket according to the third embodiment of the present invention.
Figure 8:
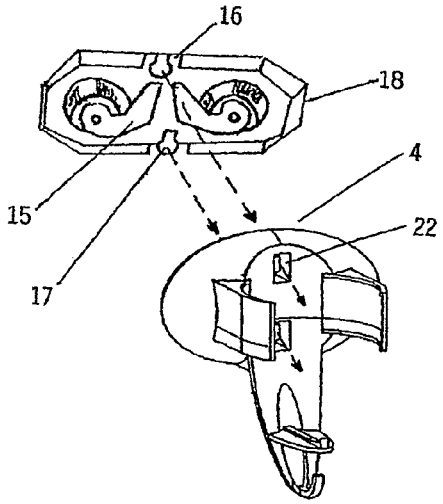
FIG. 8 is a schematic view showing the combination of the base in the shape of bracket and the adsorption connected apparatus according to the third embodiment of the present invention.

As shown in FIGS. 6-8, said base 4 is a bracket, and the jointing part is a well-known vacuum adsorption connected apparatus 18 which is adsorbed to the holder part by cupulas 19 on the reverse thereof. Said holder part is a wall whose surface is smooth. The front of the connected apparatus 18 is jointed detachedly with the reverse of the bracket. The front of the connected apparatus 18 is provided with sunk pits 16 in which bulges 17 with chucks are formed, and the bulges 17 extend outward from the front of the connected apparatus. The bracket includes a vaulted hood 20 provided with sleeves 22 extending reverseward therefrom, and said sleeves 22 and bulges 17 are nested correspondingly in the form of the ends of the bulges 17 being not exceeding the front of the hood 20 after nesting. The bracket further includes two side limit panels 21, a piece of prolonged backboard and a bottom splint 23. The two side limit panels 21 which extend outward are fixed on the front of the hood 20 and are located on the both sides of said inserted drier body 2. The prolonged backboard which extends downwards from the front of the hood 20 is located between the two side limit panels 21. The bottom splint 23 located on the bottom of said inserted drier body 2 is fixed on the front of the prolonged backboard and extends outward. In addition, a pothook 24 can be formed at the bottom of the prolonged backboard.

The user can operate the drier as follows, firstly, unfasten the two levers 15 on the front of the adsorption connected apparatus 18 to make them keep vertical, then press the two cupulas 19 on the of the apparatus 18 closely upon the wall, then press the two levels 15 return in opposite directions until they parallel to the front of the connected apparatus 18. At that time, the connected apparatus 18 adsorbs closely to the wall by the two cupulas 19. Then insert the sleeve 22 of the hood 20 of the bracket into the corresponding sunk pits 16 in the front of the connected apparatus 18 and make it nest with the bulges 17. Consequently the bracket is jointed to the front of the connected apparatus 18. Finally, insert the drier body 2 from bottom to top until the drier body 2 is among the two side limit panels 21 and the bottom bracket 23. It should be understood that the jointing part can be connected with the wall by other well-known connected means, such as nailing or bonding and the like. Similarly, the bracket also may be connected with the jointing part by other well-known connected means, such as screwing and the like. In addition, the holder part also may be other objects whose surface are smooth, such as mirror or tabletop and so on.

Figure 9:
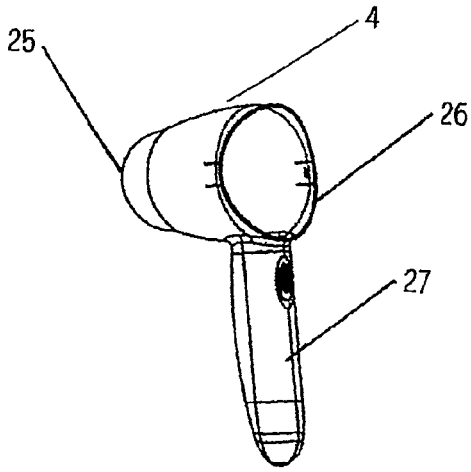
FIG. 9 is a schematic view showing the structure that of the base are connected with the handle according to the fourth embodiment of the present invention.

As shown in FIG. 9, said base 4 is a sleeve which is nested onto the sidewalls of said drier body 2; said jointing part belongs to a certain part surface of the outerwall of the sleeve which is in line with a part surface of the holder part and is connected with the holder part. Said holder part is a handle 27 whose surface connecting with the base is its top surface. The top surface of the handle 27 is pasted fixedly with the part surface acting as the jointing part of the base in the shape of a sleeve.

The user can operate the drier as follows, insert the head 1 acting as the air outflow end of the drier body 2 from the reverse 26 of the sleeve in order to pass it through the front 25 of the sleeve, and then use it with the handle 27 in his hand. It should be understood that the base 4 may be manufactured to integrate with the handle 27, or connect detachedly with the handle 27 by the means of chucking and so on. The base 4 may be manufactured to be an openable sleeve, in that way, even if the cross section of the two ends of the drier body 2 is bigger than that of the sleeve opening, the sleeve will cradle the outerwall of the drier body 2.

The drier of this invention may comprise an extended head, which is connected detachedly with the exterior of the head 1 of the air outflow end of the drier body 2.

Figure 10:
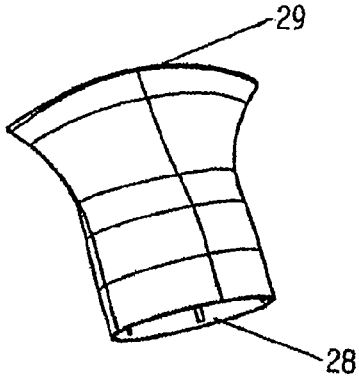
FIG. 10 is a schematic view showing the structure of the first kind of extended head attached to the drier body according to the present invention.

As shown in FIG. 10, said extended head is an air outflow opening, the tail 28 of which is nested tightly outside the head 1 of said drier body 2. And the head 29 of the air outflow opening is in the shape of a flat mouth.

Figure 11:
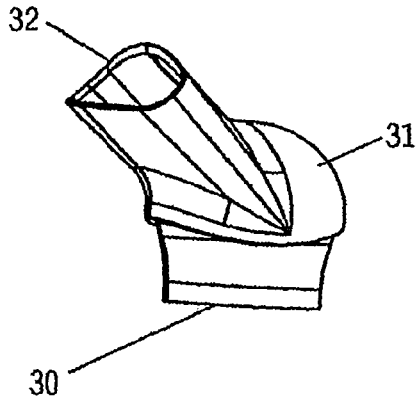
FIG. 11 is a schematic view showing the structure of the second kind of extended head attached to the drier body according to the present invention.

As shown in FIG. 11, said extended head is an air outflow passage run-through along its axis, the tail 30 of which is nested tightly outside the head 1 of said drier body 2. The middle 31 of the air outflow passage swells out like a sphere. The head 32 and tail 30 of the air outflow passage form a certain angle with the middle 31 thereof as the peak of the angle.

Figure 12:
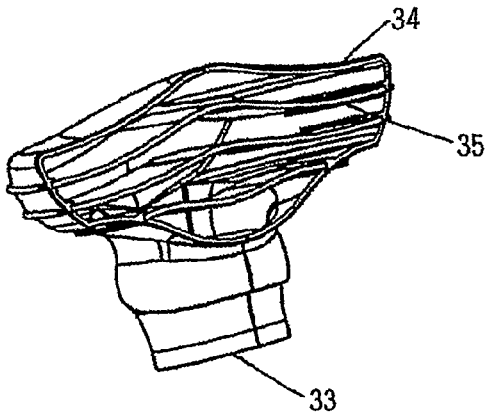
FIG. 12 is a schematic view showing the structure of the third kind of extended head attached to the drier body according to the present invention.

As shown in FIG. 12, said extended head is a through air outflow head, the tail 33 of which is nested tightly outside the head 1 of said drier body 2. And the head 34 thereof swells out along its radial like a semicircular cake. Some crossbars 35 are arranged in the air outflow opening of the head 34 of said air outflow end.

Figure 13:
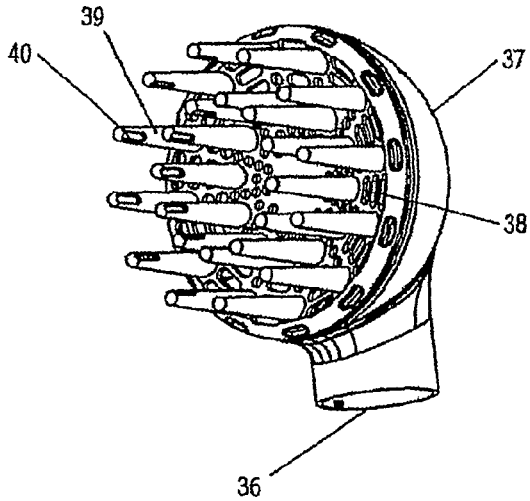
FIG. 13 is a schematic view showing the structure of the fourth kind of extended head attached to the drier body according to the present invention.

As shown in FIG. 13, said extended head is a through air outflow head, the tail 36 of which is nested tightly outside the head 1 of said drier body 2, and the head 37 of which is a hollow hemispheroid. There are some ventilation holes 38 and some outward tubes 39 in the shape of punctures on the plane of the hollow hemispheroid. The tails of the tubes 39 are connected with the hemispheroid and the tops of the tubes 39 are provided with ventilation holes 40. Said extended head is used for both blowing and satisfying the requirement of combing hair simultaneously.

Figure 14:
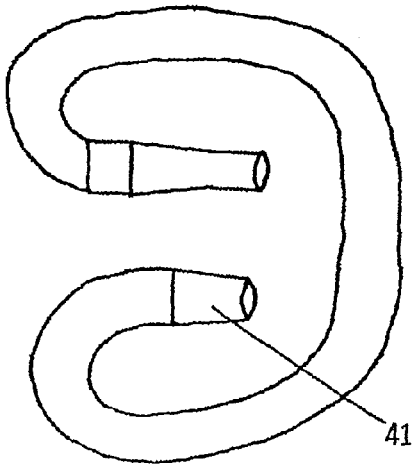
FIG. 14 is a schematic view showing the structure of the fifth kind of extended head attached to the drier body according to the present invention.

As shown in FIG. 14, said extended head is a through hose run-through along its axis, both the tail and the head of which are two sleeves respectively. The sleeve 41 acting as the tail is nested tightly outside the head 1 of said drier body 2. The sleeve acting as the head may be used for blowing directly, or be used by nesting it onto the tail of the other extended heads.

Figure 15:
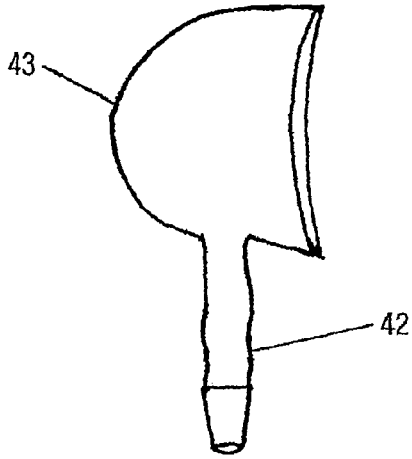
FIG. 15 is a schematic view showing the structure of the sixth kind of extended head attached to the drier body according to the present invention.

As shown in FIG. 15, the tail of said extended head is in the shape of a sleeve and be nested tightly outside the head 1 of said drier body 2; and the middle of said extended head is a through hose 42, and the head of said extended head is a cover 43 made of flexible material which is connected with the through hose 42. Furthermore, said cover 43 also may be made of rigid material and used by covering a head.

Figure 16:
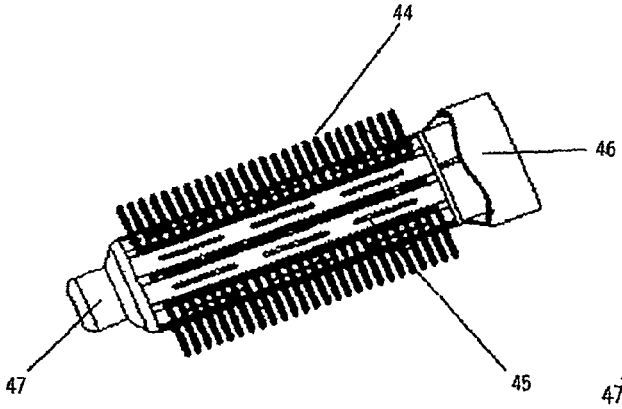
FIG. 16 is a schematic view showing the structure that the ventilation tube is connected fixedly with the sleeve of the seventh kind of extended head attached to the drier body according to the present invention.
Figure 17:
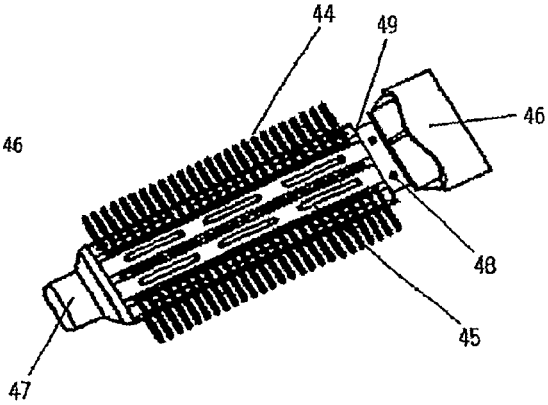
FIG. 17 is a schematic view showing the structure that the ventilation tube is connected detachedly with the sleeve of the seventh kind of extended head attached to the drier body according to the present invention.

As shown in FIGS. 16-17, said extended head is divided into two parts. The first part is a ventilation tube with a closed head 47. There are some rows of comb teeth 44 extending outward arranged along the longitudinal direction of the surface of the ventilation tube. There are some ventilation slots 45 arranged on the wall of the ventilation tube between the every row of comb teeth 44. The inner wall of the tail of the ventilation tube is provided with grooves. The second part is a sleeve 46 whose tail is nested tightly outside the head 1 of said drier body 2. The diameter of a segment of front part 49 of said sleeve is smaller than that of the tail of the ventilation tube, and the outer wall of front part 49 of the sleeve is provided with projected chucks 48. The ventilation tube and the sleeve can be fastened together via the grooves and the chucks. When the drier is put into operation, the chucks 48 can be placed into the grooves on the inner wall of the ventilation tube so as to make the ventilation tube connect fixedly with the sleeve 46. The user may pull the ventilation tube towards the head 47 thereof so as to make the chucks 48 away from the grooves. Thereby the ventilation tube may be rotated around the part no chucks 48 of the front 49 of the sleeve, and so the user may curl the hair only by rotating the ventilation tube without rotating the drier body.

PRACTICABILITY IN INDUSTRY

As the drier in accordance with the present invention comprises a base which is detachable from the base, the user can choose to hold the drier in hands or place it steadily on any desired place or surface of an object. That is to say, there is no position limit for the drier and it's possible to improve the working flexibility of the drier.

What is claimed is:

1. A drier comprising a drier body; a base which is detachable from the drier body; a jointing part and a holder part; the base is provided with an opening for inserting the drier body; the drier body is connected to the base through the opening; the base is mounted to the holder part by said jointing part; wherein the base is a bracket and the jointing part is a vacuum adsorption connected apparatus which is adsorbed to the surface of said holder part by cupulas on the reverse thereof; the front of the connected apparatus is connected detachedly with the reverse of the bracket; the front of the connected apparatus is provided with sunk pits in which bulges with chucks are formed; the bulges extend outward from the front of the connected apparatus; the bracket includes a vaulted hood provided with sleeves extending reverseward therefrom; the sleeves and the bulges are nested correspondingly; wherein ends of the bulges do not exceed the front of the hood after nesting; the bracket further includes two side limit panels, a prolonged backboard and a bottom splint; the two side limit panels extending outward are fixed on the front of the hood and are located on both sides of the inserted drier body; the prolonged backboard extending downwards from the front of the hood is located between the two side limit panels; and the splint is fixed on the front of the prolonged backboard extending outward and is located on the bottom of the inserted drier body.

2. A drier according to claim 1, wherein the holder part of the drier is a wall whose surface is smooth.

3. A drier comprising a drier body; a base detachable from the drier body; the drier body further defining an outlet; a jointing part and a holder part; an opening for inserting the drier body into the base; the base is mounted to the holder part by the jointing part, wherein the base is a sleeve which is nested onto the sidewalls of the drier body, wherein the jointing part forms an outer wall of the sleeve which is in line with and connected with the holder part, wherein the outlet faces away from the base, wherein the holder part is a handle having a top surface connecting with the base at the jointing part of the base, wherein the drier further includes an extended head connected with an exterior of the head of the drier body acting as an air outflow end of the drier body, wherein the extended head is further divided into two parts wherein the first part is a ventilation tube having a closed head and a tail, the closed head having rows of comb teeth extending outward arranged along the longitudinal direction of a surface of the ventilation tube and multiple ventilation slots arranged on a wall of the ventilation tube between the rows of comb teeth, the inner wall of the tail of the ventilation tube is provided with grooves; the second part is a sleeve; the diameter of a segment of a front part of the sleeve is smaller than that of the tail of the ventilation tube, and an outer wall of a front part of the sleeve is provided with projected chucks, wherein the ventilation tube and the sleeve are fastened together via the grooves and the chucks.

4. A drier comprising a drier body having a tail; a base detachable from the drier body; a jointing part and a holder part; an opening for inserting the drier body into the base; the base is mounted to the holder part by the jointing part; wherein the base is a sleeve which is nested onto the sidewalls of the drier body; wherein the jointing part forms an outer wall of the sleeve which is in line with and connected with the holder part, wherein the holder part is a handle having a top surface connecting with the base at the jointing part of the base, wherein the drier body includes an extended head connected with an exterior of the head of the drier body acting as an air outflow end of the drier body, wherein the extended head is further divided into two parts, wherein the first part is a ventilation tube having a closed head and a tail; the closed head having rows of comb teeth extending outward arranged along the longitudinal direction of a surface of the ventilation tube and multiple ventilation slots arranged on a wall of the ventilation tube between the rows of comb teeth; the inner wall of the tail of the ventilation tube is provided with grooves; the second part is a sleeve; the diameter of a segment of a front part of the sleeve is smaller than that of the tail of the ventilation tube, and an outer wall of a front part of the sleeve is provided with projected chucks, wherein the ventilation tube and the sleeve are fastened together via the grooves and the chucks.

* * * * *